United States Patent [19]

McGinn

[11] 4,030,543

[45] June 21, 1977

[54] WELL TUBING MANDREL WITH COMBINATION GUARD, GUIDE AND LATCH ARRANGEMENT

[75] Inventor: Ferdinand M. McGinn, Lafayette, La.

[73] Assignee: Production Specialties, Inc., Lafayette, La.

[22] Filed: Sept. 13, 1976

[21] Appl. No.: 722,535

[52] U.S. Cl. ..... 166/117.5
[51] Int. Cl.[2] ..... E21B 23/00
[58] Field of Search ..... 166/117.5

[56] References Cited

UNITED STATES PATENTS

| | | | |
|---|---|---|---|
| 2,988,146 | 6/1961 | Fredd | 166/117.5 |
| 3,353,608 | 11/1967 | Beebe et al. | 166/117.5 |
| 3,827,490 | 8/1974 | Moore, Jr. et al. | 166/117.5 |

*Primary Examiner*—James A. Leppink
*Attorney, Agent, or Firm*—Jack W. Hayden

[57] ABSTRACT

A mandrel for use in a well tubing has a body with a bore extending therethrough for alignment with the well tubing with a valve pocket offset from the mandrel bore for receiving a valve or other tool therein and guard and guide means for particular configuration are formed at the upper end of said pocket to restrict access thereto and includes projection means to assist in retaining valves in position in the valve pocket.

2 Claims, 5 Drawing Figures

WELL TUBING MANDREL WITH COMBINATION GUARD, GUIDE AND LATCH ARRANGEMENT

CROSS REFERENCE TO RELATED APPLICATION

The present invention discloses and claims a combination guard and guide with a projection means for use in conjunction with the invention entitled "Well Apparatus" of Gerald P. Hebert, Ferdinand M. McGinn and Hugh D. Embree filed in the Patent Office on September 13, 1976, bearing Ser. No. 722,534.

Background of the Invention

The present invention relates to retrievable mandrels and particularly to retrievable mandrels for receiving valves therein, which mandrels are provided for use in well tubing at spaced intervals therealong. The mandrels have a full opening bore extending therethrough for alignment with the well tubing to permit wireline tools to be run therethrough, or to permit tubing tools to be pumped therethrough.

The mandrel also includes a pocket offset from the mandrel bore to receive a retrievable valve or other flow control element.

A combination guard and guide of relatively simple configuration is provided at the upper end of the pocket and is constructed and arranged to permit devices of a desired or predetermined diameter to enter the side pocket with a cooperating latch or lug arrangement to assist in retaining the valve in position in the pocket.

Still another object of the present invention is to provide a guard at the upper end of a side pocket in a side pocket mandrel which does not present any sharp surfaces or ledges in the flow path. Tubing tools which might otherwise tend to enter the valve pocket and guided by the present invention back into the main bore of the mandrel for movement through the tubing so that access to the valve pocket is thus restricted. Projection means are provided at the lower end of the guide and guard and above the valve pocket for assisting in retaining a valve in the valve pocket after it has been deposited therein.

DESCRIPTION OF THE PREFERRED EMBODIMENT

Figure 1:
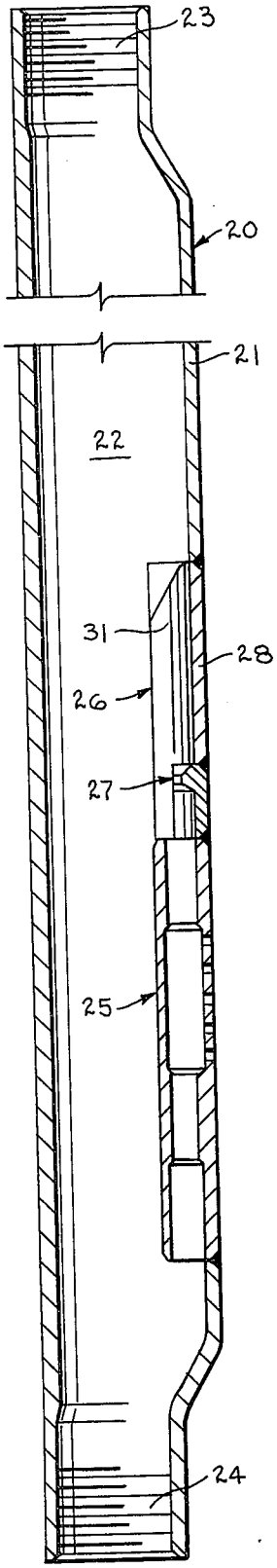
FIG. 1 is a sectional view of a mandrel showing the main bore, offset valve pocket, combination guard and guide with the projection means at the lower end immediately above the valve pocket.

Attention is first directed to FIG. 1 of the drawings wherein a mandrel represented generally at 20 is shown as including a body 21 have a bore 22 extending therethrough with threads 23 and 24 formed at each end of the body for connecting the mandrel into a tubing string. When the body 21 is connected in the tubing string (not shown), the bore 22 is aligned with the bore of the tubing string for receiving various tubing equipment therethrough such as safety valves, fishing tools, and the like, as well as gas lift valves and control valves to be seated within the mandrel 20.

The mandrel 20 includes the enlargement which is offset from the main bore 22 and in which a valve receiving pocket referred to generally at 25 is mounted to form a receptacle for receiving a flow control valve or gas lift valve therein.

The tubing bore equipment inserted in the tubing string may be in some instances pumped down, or lowered on a wireline, and it is desirable that such equipment not enter or hang up in the side pockets 25. It can be appreciated that where deviated holes are encountered, or due to other circumstances, such tubing equipment may move to the lateral offset portion of the mandrel or enlargement away from the main bore 22 therethrough and tend to enter the valve pocket 25.

To overcome this, a combination guard and guide 26 is arranged at the upper end of the valve pocket 25 as shown in FIG. 1 to restrict access thereto so that only tools of a predetermined diameter will pass into the guard 26 and then be guided into the valve pocket 25 for seating therein. The valve pocket also includes projection means referred to generally at 27 for assisting in retaining a valve in position in the valve pocket 26.

It will be noted that the valve pocket 25 is illustrated as being welded in position in the enlargement formed in the mandrel 20. The guide pocket 26 is illustrated as being welded adjacent the upper end of the valve pocket 25 and in FIGS. 2 and 4 the preferred form of the guard means 26 is illustrated in greater detail.

The body of the combination guard and guide is of generally semicircular shape, the semicircular portion 28 of which forms a wall of the enlargement of the mandrel 20 as shown in FIG. 1. The semicircular body 28 includes sides 30 and 31 which extend towards the open bore 22 as better shown in FIG. 1 of the drawings to define the front of the combination guard and guide.

Figure 2:
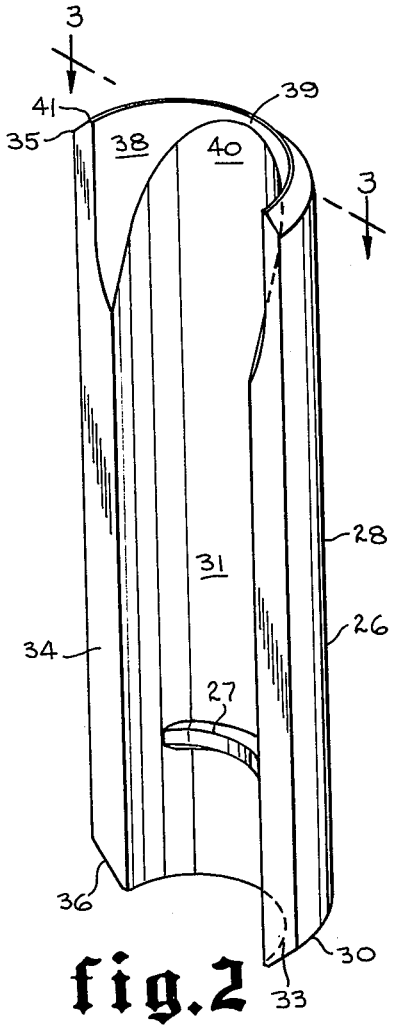
FIG. 2 is a perspective view of one form of the combination guide and guard.
Figure 3:
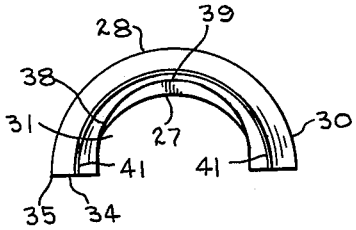
FIG. 3 is an end view on the line 3—3 of FIG. 2.
Figure 5:
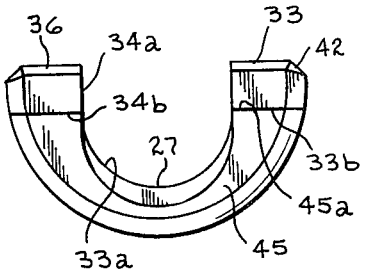
FIG. 5 is a view on the line 5—5 of FIG. 4.

The sides 30 and 31 each have substantially vertical edge portions 33 and 34 which extend from the upper end 35 to the lower end 36 of the semicircular body. The upper end of the semicircular body is provided with a curved surface 38 which at its upper end 39 intersects the inner surface 40 of the semicircular body 28 as is shown in FIGS. 2 and 3. The surface 38 is tapered downwardly from the upper end 35 downwardly and inwardly of the sides 30, 31 and semicircular body 28 as shown in the drawings. It will be noted that the surface 38 originates at the upper end 35 in the vertical edges 33 and 34 at a point 41 spaced inwardly from the outer surface of each of the sides 30 and 31. This arrangement provides a configuration so that only a tool of a predetermined size can be received within the guard 28 for seating it within the valve pocket 25. The projection means 27 formed on the lower end of the semicircular body 28 provides a lug means to enable the valve which is positioned in the valve pocket 25 to remain seated therein.

Figure 4:
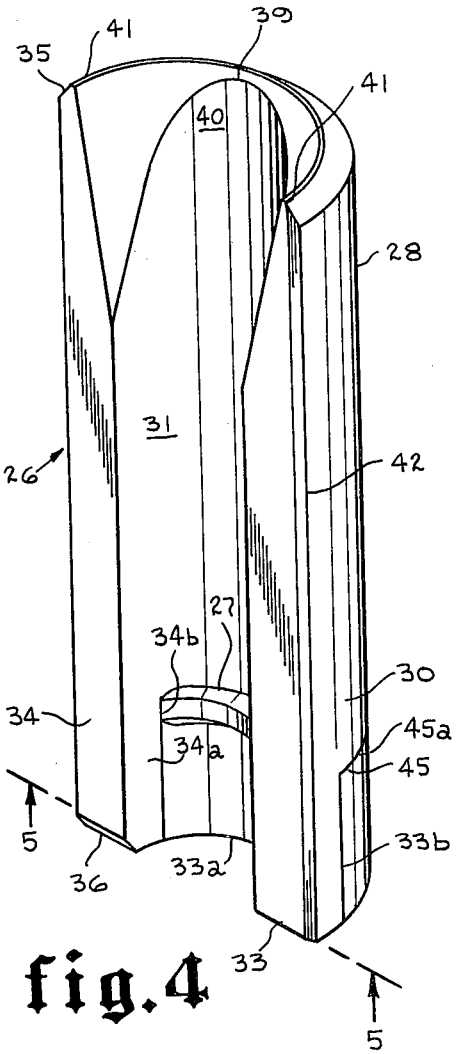
FIG. 4 is a perspective view of an alternate form of the combination guide and guard.

In the form of the invention shown in FIG. 2, the guard is shown when it is forged; however, when the guard is machined, it will assume the configuration illustrated in FIG. 4 which is similar to that shown in FIG. 2 but is modified at the lower end to enable the projection means 27 which is machined on a separate part and then seated on the machined semicircular body 28 and welded thereto. In FIG. 4 it will be noted that the semicircular body is cut away as illustrated at 45 as are the sides 30 and 31, but terminates in spaced relation to the vertical edges 33 and 34 whereby the sides each include portions 33*a* and 34*a* which now extend longitudinally beyond the termination of the semicircular body 28. The surfaces 33*b* and 34*b* in cooperation with the surface 45*a* formed at the juncture of the cut away provide surfaces for receiving a member on which the lug or projection means 27 is formed for welding with the guard 26 to become an integral part thereof.

The foregoing arrangement, provides a combination guard, guide and projection means which initially restricts access to the valve pocket 25 so that only tools of a predetermined size may be positioned therein and which after being positioned therein is retrievably retained in such position by the latch or projection means 27.

Thus when tubing equipment is either pumped or lowered into the tubing string on a wireline it will be deflected from entering the valve pocket 25 should it move laterally the bore 22 extending through the mandrel 20. However, the diameter of the guard 26 is such that when it is desired to insert a tool in the pocket 25, such may be accomplished without any problem since the guard 26 will permit such predetermined sized device to be received within the pocket 25. After the valve has been seated within the valve pocket 25, the projection means 27 functions to assist in retaining such valve in position therein.

From the foregoing description, it can be appreciated that an arrangement is provided which restricts access to the valve pocket 25 on the one hand, but which does not provide any surfaces that might tend to collect debris so as to interfere with the proper functioning of running tools through the tubing or seating and removing a valve from the valve pocket 25.

The foregoing disclosure and description of the invention are illustrative and explanatory thereof, and various changes in the size, shape, and materials as well as in the details of the illustrated construction may be made without departing from the spirit of the invention.

What is claimed is:

1. In a mandrel for use in a well tubing including:

a. a body having an open bore extending therethrough for alignment with the well tubing;

b. a valve receptacle formed in said mandrel body and offset from the open bore of said body;

c. combination guard and guide means formed at the upper end of said valve receptacle and offset from the open bore of said body, said combination guard and guide including:

1. a body of generally semicircular shape having a portion which forms part of the mandrel body that is offset from the open bore of said mandrel body and is adjacent and above said valve receptacle;

2. said semicircular body including sides extending toward the open body bore to define the front of said combination guard and guide;

3. said sides each having a substantially vertical edge extending from the upper to the lower end of said body;

4. a tapering surface formed on the upper end of said body and extending generally inwardly and downwardly to form an opening in said guard and guide of a desired configuration to restrict access to said valve receptacle immediately therebelow; and d. projection means adjacent the lower end of said semicircular body and extending inwardly of said semicircular body to form lug means to assist in retaining a valve in said valve receptacle.

2. In a mandrel for use in a well tubing including:

a. a body having an open bore extending therethrough for alignment with the well tubing;

b. a valve receptacle formed in said mandrel body and offset from the open bore of said body;

c. combination guard and guide means formed at the upper end of said valve receptacle and offset from the open bore of said body, said combination guard and guide including:

1. a body of generally semicircular shape having a portion which forms part of the mandrel body that is offset from the open bore of said mandrel body and is adjacent and above said valve receptacle;

2. said semicircular body including sides extending toward the open body bore to define the front of said combination guard and guide;

3. said sides each having a substantially vertical edge extending from the upper to the lower end thereof;

4. a tapering surface formed on the upper end of said body and extending generally inwardly and downwardly to form an opening in said guard and guide of a desired configuration to restrict access to said valve receptacle immediately therebelow; and 5. said semicircular body having a cut away portion adjacent the lower end thereof that terminates in spaced relation to the vertical edges of said sides whereby said sides extend longitudinally beyond said body to form in cooperation with the cut away portion of said semicircular body receiving surfaces for projection carrying means.

* * * * *